US006070614A

United States Patent [19]

Holzheimer et al.

[11] Patent Number: 6,070,614

[45] Date of Patent: Jun. 6, 2000

[54] FAUCET MOUNTING SYSTEM WITH IMPROVED BEARING SUPPORT

[75] Inventors: John C. Holzheimer, Eastlake; Nagib Nasr, Westlake, both of Ohio

[73] Assignee: Moen Incorporated, North Olmsted, Ohio

[21] Appl. No.: 09/263,575

[22] Filed: Mar. 8, 1999

[51] Int. Cl.[7] ..... E03C 1/04

[52] U.S. Cl. ..... 137/801; 137/359; 137/615

[58] Field of Search ..... 137/359, 615, 137/801

[56] References Cited

U.S. PATENT DOCUMENTS

| | | | |
|---|---|---|---|
| 4,103,709 | 8/1978 | Fischer | 137/359 |
| 4,848,395 | 7/1989 | Krippendorf . | |
| 5,073,991 | 12/1991 | Marty . | |
| 5,090,062 | 2/1992 | Hochstrasser . | |
| 5,095,554 | 3/1992 | Gloor . | |
| 5,301,715 | 4/1994 | Becker . | |
| 5,349,987 | 9/1994 | Shieh . | |
| 5,361,431 | 11/1994 | Freier et al. . | |
| 5,388,287 | 2/1995 | Tischler et al. . | |
| 5,458,154 | 10/1995 | Niemann et al. . | |
| 5,464,045 | 11/1995 | Niemann et al. . | |
| 5,660,203 | 8/1997 | Gnauert et al. . | |
| 5,715,868 | 2/1998 | Ching et al. . | |
| 5,758,690 | 6/1998 | Humpert et al. . | |

*Primary Examiner*—Gerald A. Michalsky
*Attorney, Agent, or Firm*—McEachran, Jambor, Keating, Bock & Kurtz

[57] ABSTRACT

A faucet mounting system for positioning and supporting a faucet valve body and a rotatable receptor on a sink deck includes a stand and a bearing member. The faucet valve body is mounted in the stand above the sink deck and the bearing member is formed and adapted to be mounted on the sink deck. The bearing member has a central opening to accommodate water conduits extending from the sink deck to the valve body. The rotatable receptor moves about the valve body and is supported for rotation on the bearing member. There are cooperating elements on the bearing member and the stand for interlocking these two elements together to prevent relative rotation there between. The bearing member has arcuately spaced stops which limit rotation of the receptor on the bearing member.

11 Claims, 3 Drawing Sheets

32
30
10
102
90
28
84
88
104
26
72
60
16
36
38
20
24
22
18
98
64
70
68
66
54
58
42
52
50
14
12
62
80
76
74
5

Fig. 5.
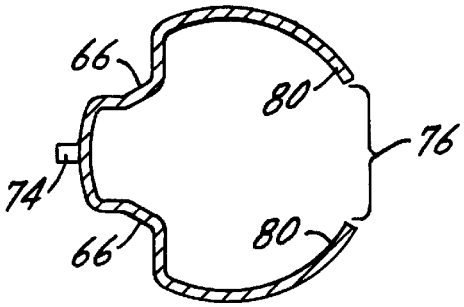
Fig. 6.
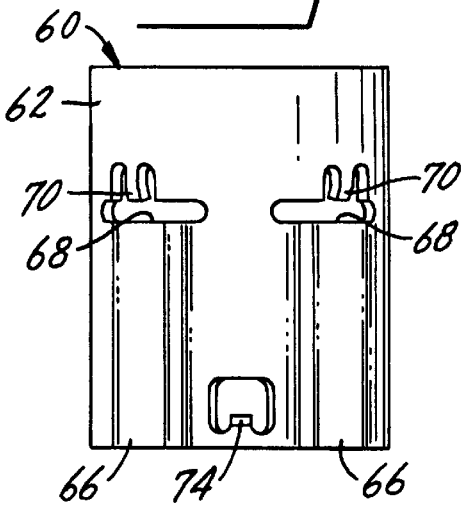
Fig. 7.
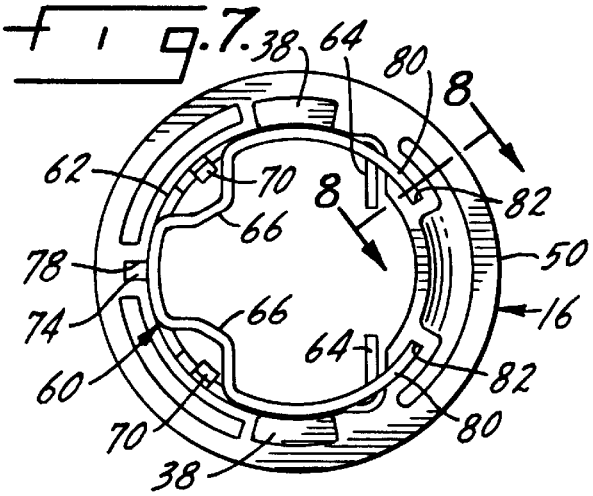
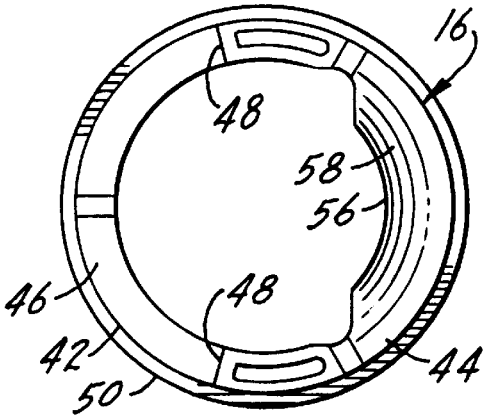
Fig. 9.
Fig. 11.
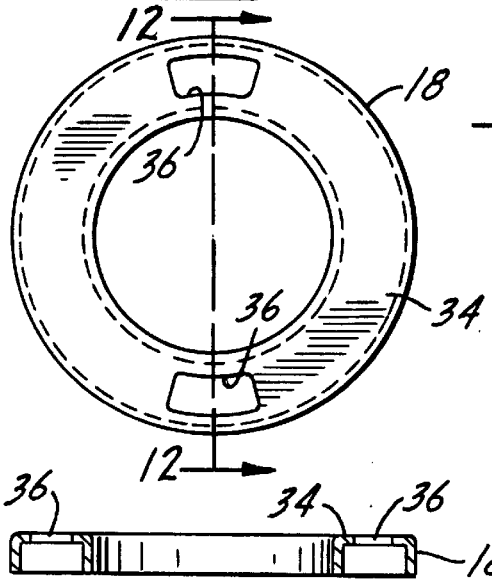
Fig. 12.
Fig. 8.
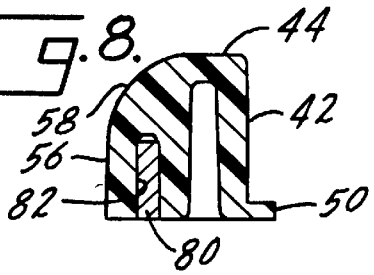
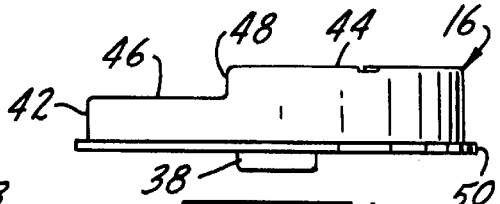
Fig. 10.

Fig. 13.
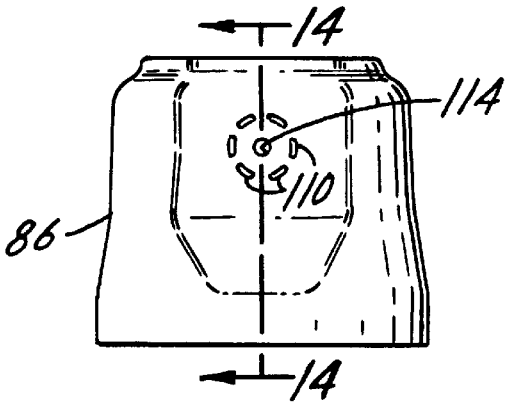
Fig. 14.
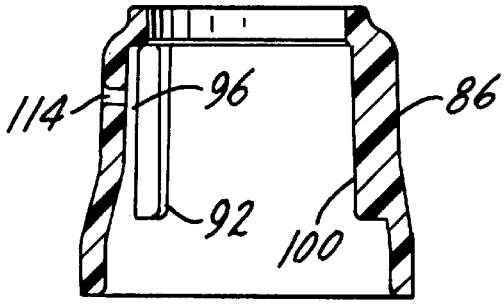
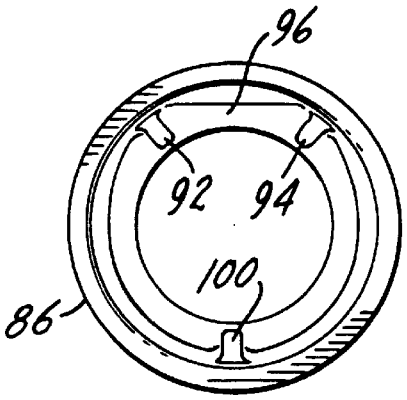
Fig. 15.
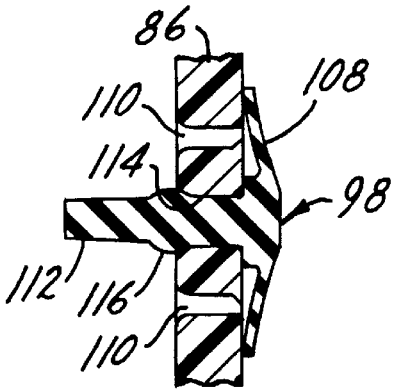
Fig. 16.
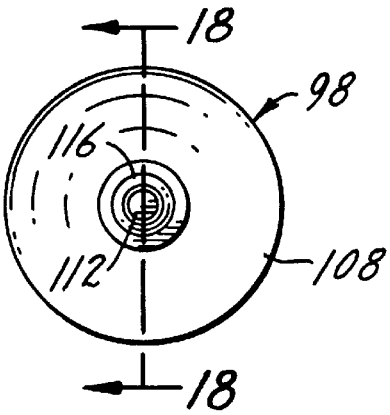
Fig. 17.
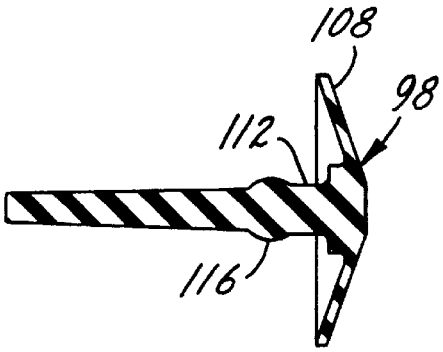
Fig. 18.

FAUCET MOUNTING SYSTEM WITH IMPROVED BEARING SUPPORT

THE FIELD OF THE INVENTION

The present invention relates to mounting systems for faucet valve bodies and more particularly faucet valve bodies which are a part of a pullout wand faucet assembly. Among the problems in prior art mounting assemblies for the stated environment is that the faucet spout receptor, usually made of brass or zinc, is rotated on and stopped against a brass cast surface, causing metal to metal contact at the limits of receptor rotation. This is annoying and gives the user the impression of less than high quality. The present invention provides a non-metallic or plastic bearing support member which provides the stops limiting receptor rotation to thereby eliminate this problem.

Previous pullout faucet receptors did not include any element to readily align the faucet to the sink. A misaligned faucet created several problems. The hot and cold water rotation limits, as well as the spout receptor rotation limits are oriented to the center of the faucet. If the faucet is not aligned with the sink, the rotations will not seem intuitive to the consumer who may try and force the receptor and/or handle past their intended limits, damaging the faucets. This again provides a perception or image of poor quality. The present invention eliminates this problem by providing stops or projections to positively align and position the bearing member and thus the entire faucet assembly with the underlying support surface or sink deck.

In previous faucet wand constructions the metal jacketed hose which supplies water to the faucet wand would have metal to metal contact against a brass casting which was a part of the faucet support assembly. In the present invention the plastic or non-metallic bearing member has a smooth molded surface for the hose to ride on, reducing both noise and wear on the hose.

Moreover, in the present invention, a specific material was chosen for the bearing washer to reduce the potential for corrosion to parts of the faucet due to electrolytic activity at the interface between the faucet and the underlying escutcheon or sink deck. By using a plastic element or plastic bearing member, there is electrolytic isolation between the pullout faucet, normally made of zinc and/or brass, and the escutcheon which is also usually metallic.

SUMMARY OF THE INVENTION

The present invention relates to faucet mounting systems and more specifically to the support system for a pullout wand faucet assembly.

A primary purpose of the invention is to provide a faucet mounting system which eliminates noise, provides a positive stop to receptor movement and provides the consumer with a perception of a high quality faucet assembly.

Another purpose of the invention is to provide a faucet mounting system which reduces electrolytic activity between a metallic escutcheon and the metallic faucet valve body.

Another purpose of the invention is to provide a faucet mounting system for a pullout wand in which a bearing support member, formed of a non-metallic material such as plastic, has a smooth bearing surface to reduce wear on the hose and noise from hose movement.

Another purpose is a faucet mounting system of the type described in which the bearing support member for the faucet assembly has means thereon for aligning the faucet assembly with the sink deck for proper and positive orientation of the faucet assembly.

Other purposes will appear in the ensuing specification, drawings and claims.

DESCRIPTION OF THE DRAWINGS

The invention is illustrated diagrammatically in the following drawings wherein:

FIG. 5 is a section along plane 5—5 of FIG. 3;

FIG. 6 is a rear view of the stand;

FIG. 7 is a bottom view of the stand and bearing support member;

FIG. 8 is a section along plane 8—8 of FIG. 7;

FIG. 9 is a top view of the bearing support member;

FIG. 10 is a side view of the bearing support member;

FIG. 11 is a top view of the escutcheon positioned between the receptor and stand;

FIG. 12 is a section along plane 12—12 of FIG. 11;

FIG. 13 is a side view of the faucet body hub;

FIG. 14 is a section along plane 14—14 of FIG. 13;

FIG. 15 is a bottom view of the hub;

FIG. 16 is a side view of the hub mounted vacuum breaker;

FIG. 17 is an end view of the vacuum breaker; and

FIG. 18 is a section along plane 18—18 of FIG. 17;

DESCRIPTION OF THE PREFERRED EMBODIMENT

Figures 1, 2, 3, 4:
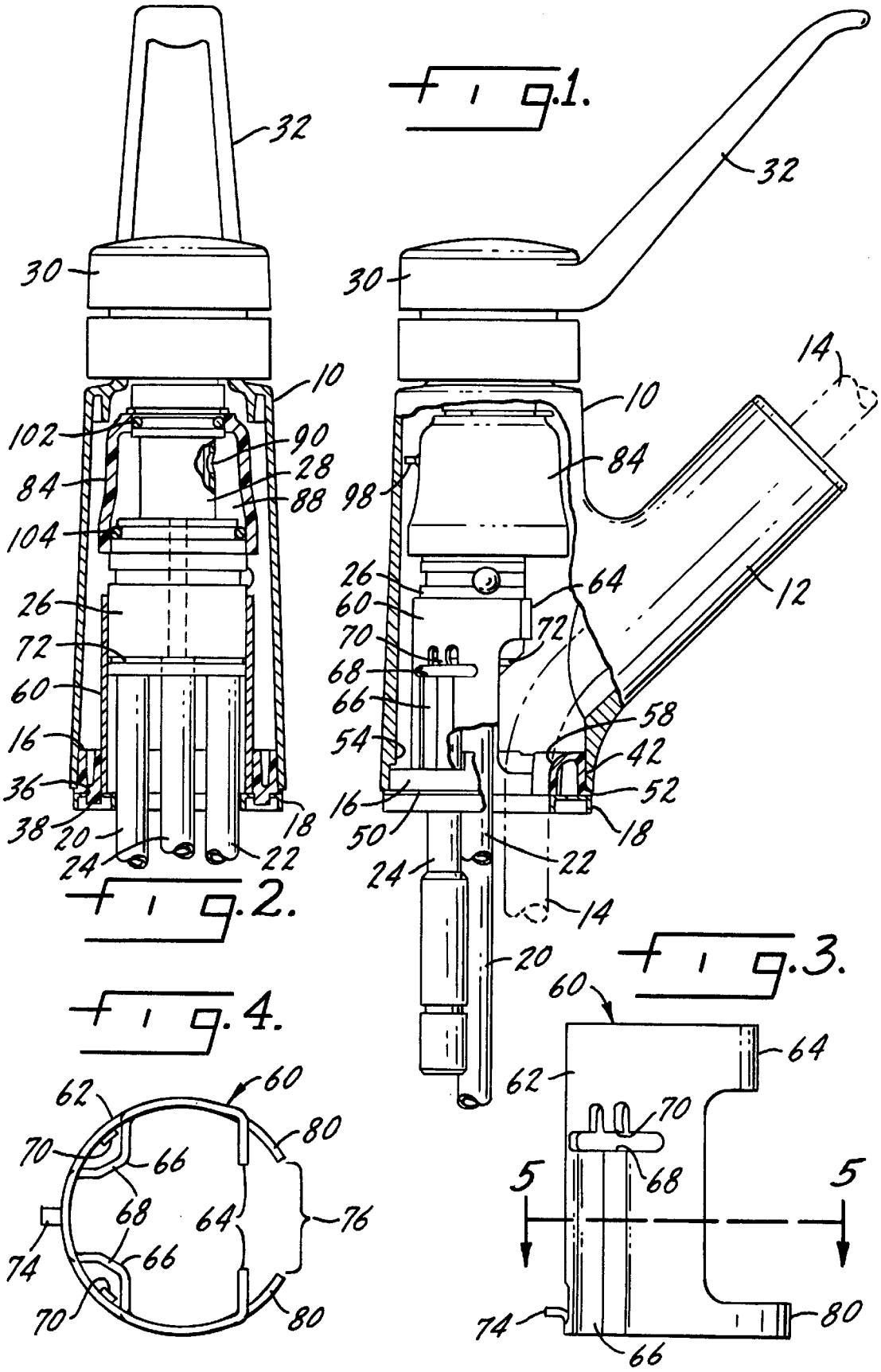
FIG. 1 is a side view of a faucet assembly of the type described, in part section.
FIG. 2 is a rear view of the faucet assembly of FIG. 1, in part section.
FIG. 3 is a side view of the support stand.
FIG. 4 is a top view of the stand.

FIG. 1 illustrates a pullout wand faucet, customarily found in the kitchen and which includes a receptor indicated generally at 10 which has a spout support portion 12 which will receive the faucet wand, not shown. The hose for the faucet wand is indicated at 14 in broken lines and extends through the faucet assembly from the wand down to the area beneath the sink deck. The receptor 10, which may be formed of plastic or of a metallic material, and which will be decorative in nature, encloses the valve body assembly and is mounted for rotation upon a bearing member 16. The bearing member 16 in turn is seated upon an escutcheon 18 which is in the form of a ring, and is illustrated in FIGS. 11 and 12. Other forms of escutcheons clearly are acceptable to support the valve assembly shown herein.

There are hot and cold water inlet conduits 20 and 22 and there is an outlet conduit 24 which will be connected to the hose 14. The conduits 20, 22 and 24 all extend into a valve body 26 which may contain a single lever valve control cartridge of the type sold by applicant, Moen Incorporated, under the trademark 1225. This cartridge is located within a cylindrical portion 28 of the valve body 26 and will have an upwardly extending stem to which will be connected the cap assembly indicated at 30 and the lever 32. Manipulation of the lever 32 will control the volume and temperature of water supplied through the hose and thus discharged from the faucet wand.

The escutcheon or ring 18 has a top surface 34 with a pair of limited arcuate slots 36 which slots will receive the downwardly extending arcuate projections 38 on the bottom of the bearing member 16, illustrated in detail in FIGS. 9 and 10 and shown combined with the stand in FIG. 7. The bearing member 16 which is preferably formed of plastic to provide electrolytic isolation between the metallic ring or escutcheon 18 and the metallic valve body 26 provides support for rotation of the receptor 10. Member 16 has an upstanding vertical wall 42 which has a first portion 44 of a greater vertical height than a second portion 46 with the junction between the portions 44 and 46 forming vertical stops 48 which limit rotation of the receptor 10. The member 16 has an outwardly extending circumferential or peripheral flange 50 which provides support for the bottom surface 52 of the receptor 10. Thus, the receptor 10 may rotate upon the bearing member and its interior surface 54 will contact the stops 48 to limit its rotation. In prior faucet assemblies of this type, rotation of the receptor was customarily limited to approximately 85 degrees. However, with the support assembly described herein, spout rotation has been expanded to approximately 145 degrees. This is clearly shown in FIG. 9.

The bearing member 16 has an arcuate portion 56, illustrated in FIG. 9 and in section in FIG. 8, which has a gradually curved surface 58 which curved surface will face the spout portion 12 of the receptor when the valve assembly is mounted on a sink deck. The hose 14 thus has a smooth non-metallic surface over which it will move when the wand is pulled out of the receptor. This is in contrast to prior art structures in which there was no such smooth non-metallic surface for movement of the hose which normally has a metallic outer sheath and thus there was both noise from hose movement and wear on the exterior of the hose. The present invention eliminates both the noise and the wear problem by the use of a non-metallic bearing member which has a curved surface over which the hose may move.

The valve body 26, which preferably is made of brass, is supported within the faucet assembly by a stand 60 illustrated in FIGS. 3, 4, 5 and 6, and in assembled version with the bearing member, in FIG. 7. Preferably the stand is formed of stainless steel. The stand must be inexpensive, but it must withstand the installation load of the faucet body without deforming and thus altering the specific orientation of the valve body. The stand must have sufficient clearance to allow the hose to move freely when the spout rotates and the material forming the stand should be similar to brass in terms of electromotive force to reduce the potential for corrosion due to electrolytic activity. The preferred material for the stand is thus stainless steel.

The stand has a generally vertical wall 62, the upper end of which has two inwardly extending tabs or projections 64 which will secure the valve body in position by bearing against a portion thereof as shown in FIG. 1. Thus, the upper end of the stand securely holds the valve body in position. The stand has two vertical ribs indicated at 66 which not only increase the vertical strength of the stand but provide a shelf at their upper end surfaces 68 for support of the valve body. The valve body 26 is held by the tabs 64 and is seated upon the vertical ribs 66. Further, the vertical wall 62 of the stand has a pair of in turned projections 70 which will extend into an annular groove 72 on the exterior of the valve body. The valve body, when assembled, will be pushed down into the stand until the projections 70 snap into the groove 72, thus permanently holding the valve body within the stand. The interengagement between the valve body and the stand includes the ribs 66, the tabs 64 and the projections 70, all combining to firmly hold the valve body in position within the stand.

The lower portion of the stand will interlock with the bearing member 16. As shown particularly in FIG. 4, a rear portion of the stand has a generally horizontally extending projection 74 which is opposite a spout opening 76 in the stand, which opening is there to accommodate movement of the hose. The projection 74 will be received within a recess 78 in the bearing member 16, as particularly shown in FIG. 7. This properly aligns the stand with the bearing member and the bearing member, as discussed above, is properly aligned with the escutcheon on the sink deck by the slots 36 and projections 38. To further hold the stand within the bearing member, the lower portion of the stand has a pair of arcuately extending projections 80, shown in FIG. 5 which will extend within arcuate grooves 82 in the lower, downwardly facing portion, of the bearing member 16. This interlocking arrangement is shown particularly in FIG. 7. The arcuate projections or extensions 80 and the mating grooves 82 on the stand and bearing member combined with the aligning projection 74 and the recess 78 all together serve to not only positively and firmly connect the stand with the bearing member, but also to align these two elements so that the entire faucet assembly will be properly located on the sink deck.

As is common and required in faucets of this kind, there must be a vacuum breaker. In the present instance, at the upper portion of the valve body, there is a vacuum vent assembly 84 which includes a hub 86 extending over the upper portion of the valve body adjacent to the location of the valve cartridge. The area inside of the hub 86 will form a chamber 88 which will receive water discharged from the valve cartridge through outlet port 90. The hub 86 as shown in FIGS. 14 and 15 may have three downwardly extending ribs, two of which, indicated at 92 and 94, are positioned closely adjacent to the vacuum breaker 98 to define a vacuum breaker chamber 96. The ribs 92 and 94 isolate water discharged from the cartridge, which may contain contamination such as sediment, from the vacuum breaker. In prior art vacuum breakers, the seal element was exposed to direct water flow which allowed contamination to get under the seal surface. This is prevented in the present construction by the use of the ribs 92 and 94. There is a third rib 100 which assists in locating the hub on the exterior surface of the valve body 26. The hub is preferably formed of plastic and will be sealed at its upper and lower extremities by seal rings 102 and 104 which are formed on the cylindrical portion 28 of the valve body which encloses the cartridge.

The vacuum breaker itself, indicated at 98 is elastomeric in form and has an umbrella portion 108 which masks a group of openings 110 in the wall of the hub 86. There is a stem 112 which extends through a hole 114 in the hub with the stem having an enlargement 116 which serves to fix the vacuum breaker to the hub.

In normal use, the umbrella portion 108 will close over the openings 110 so that no water is discharged from the hub. The outside of the hub will be at atmospheric pressure. In the event that there is a drop in line pressure supplying the faucet, and if at that time the wand were to be located in water within a sink, the negative pressure from the water supply could draw unclean water from the sink back through the faucet assembly into the water supply. However, this is prevented by the vacuum breaker assembly as if such a negative pressure were to occur, the atmospheric air outside of the hub would force its way inward, pushing the umbrella portion 108 away from the holes 110 and breaking the vacuum, preventing the backward flow of water from the sink through the faucet assembly into the potable water supply.

Of particular advantage in the invention is the unique support system for the valve body which includes the stand and the bearing member. These two elements combined not only support the faucet valve body, but they do so in a manner to provide a greater degree of rotation of the receptor relative to the sink deck, plus they eliminate wear and noise caused by movement of the hose through the faucet assembly. The use of a non-metallic bearing member eliminates the often troublesome clicking noise when the receptor is moved to the limits of its rotation. The stand is strong, being formed of stainless steel, has supporting vertical ribs, and is made of a material which will reduce electrolytic action between the valve body and the other elements of the assembly, thus lowering the potential for corrosion.

Whereas the preferred form of the invention has been shown and described herein, it should be realized that there may be many modifications, substitutions and alterations thereto.

What is claimed is:

1. A faucet mounting system for positioning and supporting a faucet valve body and a rotatable faucet receptor on a sink deck, said mounting system including a stand, the valve body being mounted in said stand above the sink deck, an annular bearing member formed and adapted to be mounted on the sink deck, said bearing member having a central opening to accommodate water conduits extending from the sink deck to the valve body, said receptor being rotatable about said valve body and being supported for rotation on said bearing member, cooperating means on said bearing member and stand for interlocking said stand and bearing member to prevent relative rotation thereof, said bearing member having arcuately spaced stops limiting rotation of said receptor thereon.

2. The faucet mounting system of claim 1 wherein said bearing member has an outwardly extending peripheral flange, and said receptor has a downwardly facing lower surface thereof which rides on said flange as said receptor is rotated relative to said bearing member.

3. The faucet mounting system of claim 1 wherein said bearing member stops include generally vertically extending surfaces thereon, which surfaces cooperate with portions of said receptor to limit rotation of said receptor relative to said bearing member.

4. The faucet mounting system of claim 1 wherein said bearing member has an upstanding annular wall extending peripherally therearound, said wall having generally vertical surfaces thereon, which define said bearing member stops.

5. The faucet mounting system of claim 4 wherein said receptor includes a faucet wand support, a hose extending through said faucet wand support, through said receptor and through said bearing member central opening, that portion of said bearing member annular wall, extending between said stops, having a curved portion thereof to ease movement of said hose relative to said bearing member.

6. The faucet mounting system of claim 5 wherein said bearing member annular wall has a first portion and a second portion, with said first portion having a greater height than said second portion, with said stops being defined by the transition between said first portion and said second portion.

7. The faucet mounting system of claim 1 in which the cooperating means on said bearing member and stand for providing an interlock therebetween include a radial recess on the interior of said bearing member opening toward said central opening, and a radially outwardly extending projection on said stand.

8. The faucet mounting system of claim 1 wherein said cooperating means on said bearing member and stand for preventing relative rotation therebetween include at least one circumferentially extending recess on an interior portion of said bearing member, and at least one circumferentially extending projection on said stand mating with said recess.

9. The faucet mounting system of claim 8 wherein said bearing member includes a pair of oppositely facing circumferentially extending recesses, and said stand includes a pair of facing circumferentially extending projections extending into said recesses for providing an interlock between said stand and bearing member.

10. The faucet mounting system of claim 1 wherein said bearing member includes at least one downwardly extending projection formed and adapted to interlock with a supporting surface.

11. The faucet mounting system of claim 1 wherein said bearing member is formed of a non-metallic material.

* * * * *